US010816145B2

(12) United States Patent
Dutta et al.

(10) Patent No.: US 10,816,145 B2
(45) Date of Patent: Oct. 27, 2020

(54) LIGHT EMITTING DIODE FILAMENT LIGHT SOURCE

(71) Applicant: LEDVANCE LLC, Wilmington, MA (US)

(72) Inventors: Arunava Dutta, Winchester, MA (US); Jason Li, Boxford, MA (US)

(73) Assignee: LEDVANCE LLC, Wilmington, MA (US)

( * ) Notice: Subject to any disclaimer, the term of this patent is extended or adjusted under 35 U.S.C. 154(b) by 135 days.

(21) Appl. No.: 16/135,027

(22) Filed: Sep. 19, 2018

(65) Prior Publication Data

US 2020/0088355 A1 Mar. 19, 2020

(51) Int. Cl.

| | |
|---|---|
| ***F21V 23/00*** | (2015.01) |
| ***F21K 9/237*** | (2016.01) |
| ***F21V 23/06*** | (2006.01) |
| ***F21K 9/232*** | (2016.01) |
| *F21Y 115/10* | (2016.01) |

(52) U.S. Cl.

CPC ..... *F21K 9/237* (2016.08); *F21K 9/232* (2016.08); *F21V 23/06* (2013.01); *F21Y 2115/10* (2016.08)

(58) Field of Classification Search

CPC ..... F21K 9/232; F21K 9/23; F21Y 2107/30

See application file for complete search history.

(56) References Cited

U.S. PATENT DOCUMENTS

| | | | | |
|---|---|---|---|---|
| 9,599,289 | B2 * | 3/2017 | Imai | F21K 9/232 |
| 2010/0207502 | A1 * | 8/2010 | Cao | F21V 3/00 313/46 |
| 2014/0268779 | A1 * | 9/2014 | Sorensen | F21K 9/232 362/249.06 |
| 2015/0036341 | A1 * | 2/2015 | Ge | F21V 13/08 362/240 |
| 2016/0369949 | A1 * | 12/2016 | Wu | H05B 35/00 |
| 2017/0084809 | A1 * | 3/2017 | Jiang | H01L 25/0753 |
| 2018/0080611 | A1 * | 3/2018 | Haberkorn | F21K 9/232 |
| 2018/0080612 | A1 * | 3/2018 | Haberkorn | F21K 9/232 |
| 2018/0347766 | A1 * | 12/2018 | Choi | F21K 9/237 |
| 2019/0226644 | A1 * | 7/2019 | Van Bommel | F21K 9/66 |

* cited by examiner

*Primary Examiner* — Andrew J Coughlin
(74) *Attorney, Agent, or Firm* — Tutunjian & Bitetto

(57) ABSTRACT

A light engine comprising a substantially tubular substrate including base portion with a plurality of slots, a first group of at least two filament LEDs on a first portion of the substantially tubular substrate, and a second group of at least two filament LEDs on a second portion of the substantially tubular substrate. Each of the first and second groups of the at least two filament LEDs being electrically connected through a base electrode to electrode contacts in the slots. The light engine also includes an electrical bus wire present proximate to the end of the substantially tubular substrate that is opposite the end at the base portion of the substantially tubular substrate, the electrical bus wire in contact with each filament LED for each of the first and second groups of at least two filament LEDs.

19 Claims, 9 Drawing Sheets

LIGHT EMITTING DIODE FILAMENT LIGHT SOURCE

TECHNICAL FIELD

The present disclosure generally relates to light engines employed in lamp assemblies, and more particularly to light engines employing light emitting diodes for the light source.

BACKGROUND

Recently, lighting devices have been developed that make use of light emitting diodes (LEDs) for a variety of lighting applications. Owing to their long lifetime and high energy efficiency, LED lamps are now also designed for replacing traditional incandescent and fluorescent lamps, i.e., for retrofit applications. For such applications, the LED retrofit lamp is typically adapted to fit into the socket of the respective lamp fixture to be retrofitted. Additionally, the light engine for retrofit LED lamps should have dimensions that fit within the opening of the optic, e.g., globe, of conventional bulb assemblies.

SUMMARY

In some embodiments, a method and structures are described for creating a light emitting diode (LED) filament light engine that does not rely on the presence of any central pillar joined to the glass stem and does not rely on the embedding of connecting wires on any portion of the pillar.

In one aspect, a light engine is provided that employs filament light emitting diodes (LEDs) that are suitable for use in lamps, such as retrofit light emitting diode (LED) lamps. The filament light emitting diodes (LEDs) make use of a substantially tubular structure for support, e.g., the tubular structure provides the substrate for the LED filaments, the connecting wires, and connection points to the lead pins of a stem assembly providing connectivity to the driving electronics of a lamp. In one embodiment, the light engine includes a substantially tubular substrate including base portion with a plurality of slots that extend into the sidewall of the substantially tubular substrate. A first group of at least two filament LEDs is present on a first portion of the substantially tubular substrate, and a second group of at least two filament LEDs is present on a second portion of the substantially tubular substrate. A first base electrode wire is present connecting each of the filament LEDs in the first group of at least two filament LEDs to a first electrode contact in a first of the plurality of slots. A second base electrode wire is present connecting each of the filament LEDs in a second group of at least two filament LEDs to a second electrode contact in a second of the plurality of slots. The first base electrode wire is separate from the second base electrode wire. An electrical bus wire is present proximate to the end of the substantially tubular substrate that is opposite the end at the base portion of the substantially tubular substrate. The electrical bus wire is present in contact with each filament LED for each of the first group of at least two filament LEDs and each of the second group of at least two filament LEDs.

In another aspect, a lamp structure is provided that includes a light engine that employs filament light emitting diodes (LEDs). In one embodiment, a lamp structure includes a housing including a light projecting end and a base having an electrical connector for connection with a lamp fixture; and a light engine positioned within the housing to project light through the light projecting end. In one embodiment, the light engine includes a substantially tubular substrate including a base portion with a plurality of slots extending into the substantially tubular substrate sidewall, and a plurality of filament light emitting diodes (LEDs) mounted to the substantially tubular substrate, wherein electrical contacts to the plurality of filament light emitting diodes (LEDs) are present in said plurality of slots. The lamp structure may further include a light stem including positive and negative leads connected to the electric contacts that are present in the plurality of slots of the substantially tubular substrate of the light engine component. The positive and negative leads are in electrical communication with the electrical connector through driver electronics that are housed within the base.

In yet another aspect of the present disclosure, a method of forming a lamp is provided in which the lamp includes a light engine having filament light emitting diodes supported by a substantially tubular substrate. In one embodiment, the method includes providing a light engine component including a substantially tubular substrate, the substantially tubular substrate including base portion with a plurality of slots extending into the substantially tubular substrate sidewall; and a plurality of filament light emitting diodes (LEDs) mounted to the substantially tubular substrate, wherein electrical contacts to the plurality of filament light emitting diodes (LEDs) are present in said plurality of slots. A light stem including positive and negative leads is connected to the electrical contacts that are present in the plurality of slots of the substantially tubular substrate of the light engine component. The light engine component is then sealed within a housing including a light projecting end provided by an optic and a base having an electrical connector for connection with a lamp fixture, wherein the positive and negative leads of the light stem are in electrical communication with the electrical connector through driver electronics that are housed within the base.

These and other features and advantages will become apparent from the following detailed description of illustrative embodiments thereof, which is to be read in connection with the accompanying drawings.

BRIEF DESCRIPTION OF THE DRAWINGS

The following description will provide details of embodiments with reference to the following figures wherein.

DETAILED DESCRIPTION

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

The present disclosure describes a light engine that employs filament light emitting diodes (LEDs) that is suitable for use in lamps, such as retrofit light emitting diode (LED) lamps. In some embodiments, methods and structures are described for creating a light emitting diode (LED) filament light engine that does not rely on the presence of any central pillar joined to the glass stem and does not rely on the embedding of connecting wires on any portion of the pillar. In some embodiments, a light engine is provided that employs filament light emitting diodes (LEDs) that are suitable for use in lamps, such as retrofit light emitting diode (LED) lamps. The filament light emitting diodes (LEDs) make use of a substantially tubular structure for support, e.g., the tubular structure provides the substrate for the LED filaments, the connecting wires, and connection points to the lead pins of a stem assembly providing connectivity to the driving electronics of a lamp. The methods and structures of the present disclosure are now described in greater detail with reference to FIGS. 1 to 9.

Figure 1:
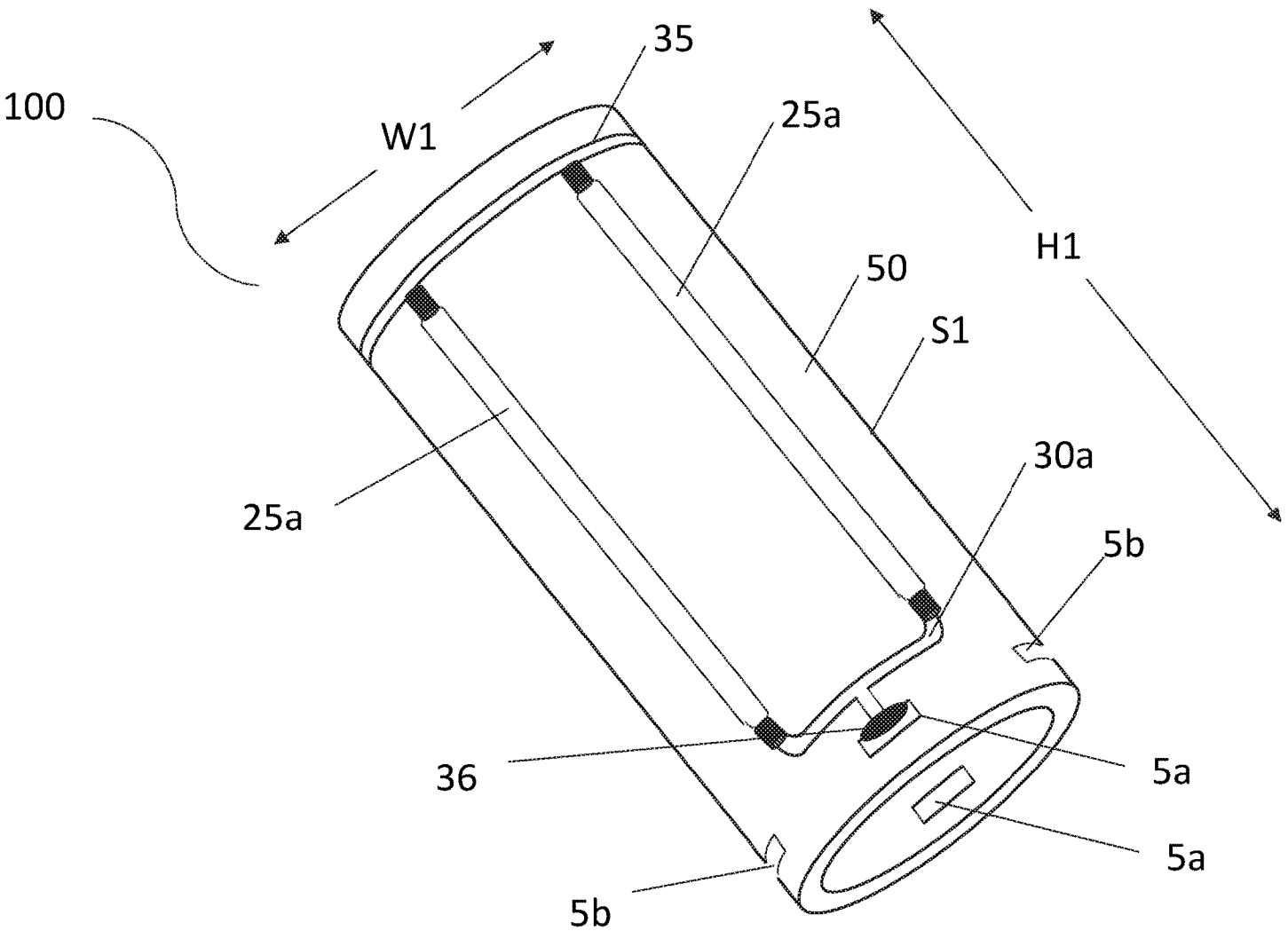
FIG. 1 is a perspective view of a light engine including a substantially tubular substrate having a base portion with a plurality of slots extending into the substantially tubular substrate sidewall, and a plurality of filament light emitting diodes (LEDs) mounted to the substantially tubular substrate, in accordance with one embodiment of the present disclosure.
Figure 2B:
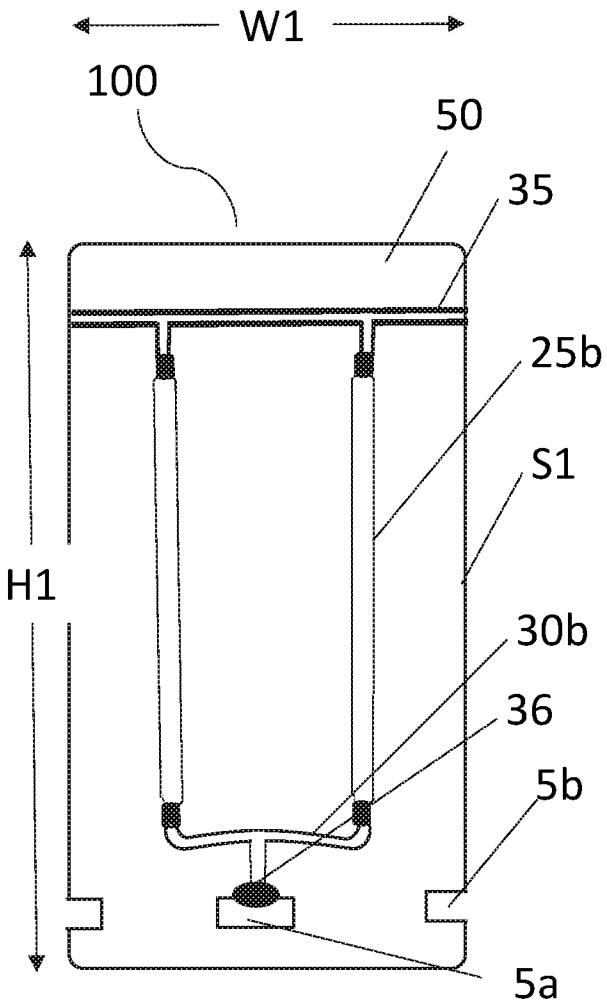
FIG. 2B is a side view of the light engine for the opposite the side of the light engine that is depicted in FIG. 2A, in which the side depicted in FIG. 2B includes a second group of at least two filament LEDs is present on a second portion of the exterior surface of the substantially tubular substrate sidewall, in accordance with one embodiment of the present disclosure.
Figure 2A:
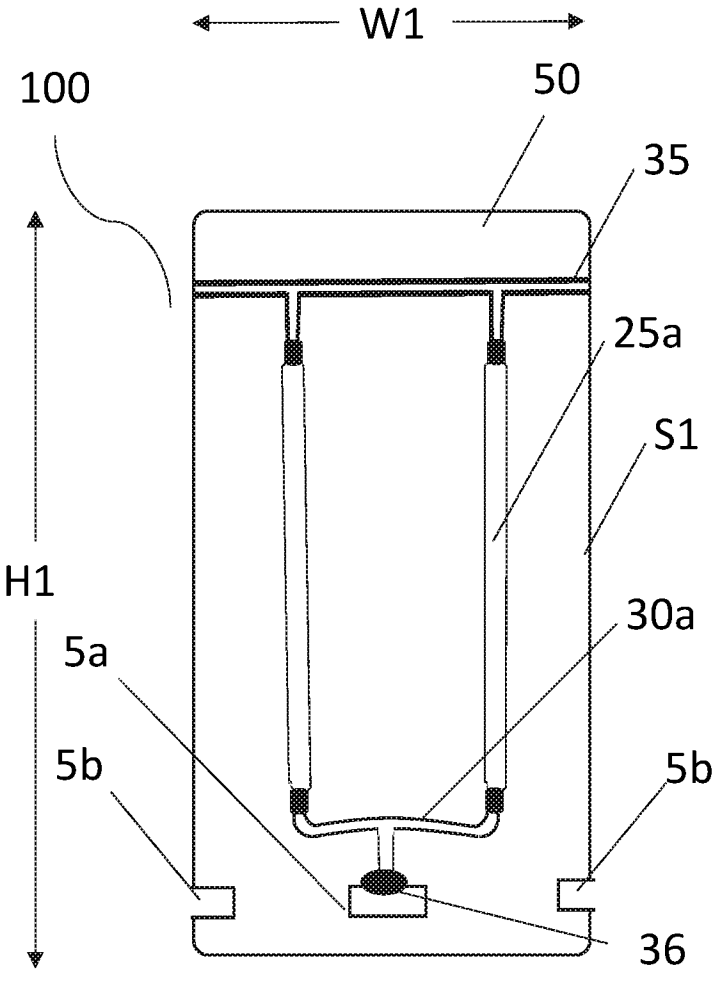
FIG. 2A is a side view of the light engine depicting a first group of at least two filament LEDs that is present on a first portion of an exterior surface of the substantially tubular substrate sidewall, in accordance with one embodiment of the present disclosure.

FIG. 1 depicts one embodiment of a light engine 100 including a substantially tubular substrate 50 having a base portion with a plurality of slots 5*a*, 5*b* extending into the substantially tubular substrate sidewall s1, and a plurality of filament light emitting diodes (LEDs) 25*a*, 25*b* mounted to the substantially tubular substrate 50. In one embodiment, the light engine 100 includes a first group of at least two filament LEDs 25*a* on a first portion of the substantially tubular substrate sidewall S1, and a second group of at least two filament LEDs 25*b* on a second portion of the substantially tubular substrate sidewall S1. In the view that is illustrated in FIG. 1, only the first group of the at least two filament LEDs 25*a* is depicted. FIG. 2A is a side view of the light engine 100 depicted in FIG. 1, in which the side of the light engine 100 depicted in FIG. 2A includes the first group of at least two filament LEDs 25*a* that are present on a first portion of an exterior surface of the substantially tubular substrate sidewall S1. The second group of filament LEDs 25*b* is not depicted in FIG. 1, because they are on the opposing sidewall of the depicted side of the substantially tubular substrate 50. FIG. 2B is a side view of the light engine 100 for the opposite the side, i.e., second side, of the light engine 100 that is depicted in FIGS. 1 and 2A. FIG. 2B depicts the second group of filament LEDs 25*b*.

Referring to FIGS. 1 and 2A, a first base electrode wire 30*a* is connecting each of the first group of said at least two filament LEDs 25*a* to a first electrode contact 36 in a first of the plurality of slots 5*a*. As will be described in further detail throughout the disclosure the plurality of slots 5*a*, 5*b* may include a first grouping 5*a* that includes first electrode contacts 36 for providing electrical communication to the first and second groups of at least two filament LEDs 25*a*, 25*b*. A second base electrode wire 30*b* may connect each of the second group of said at least two filament LEDs 25*b* to a second electrode contact 36 in a second of the plurality of slots 5*a*. The first base electrode wire 30*a* is separate from the second base electrode wire 30*b*. Similar to the second group of filament LEDs 25*b*, the second base electrode wire 30*b* is not depicted in FIGS. 1 and 2A, because it is on the opposing sidewall of the depicted side of the substantially tubular substrate 50. FIG. 2B is a side view of the light engine 100 for the opposite the side, i.e., second side, of the light engine 100 that is depicted in FIGS. 1 and 2A. FIG. 2B depicts the second base electrode wire 30*b*.

The electrode contacts 36 provide the point for electrical contact and can be portions of exposed wire and/or solder pads, etc. As noted, the electrode contacts 36 are present in only some of the slots 5*a*, which engage pins from metal lead lines 76 to the driver electronics 80 of a lamp 500. The remaining slots 5*b* may be engaged by pins from similar geometry wire type structures (supporting members 77) that provide structural support for the light engine 100, and do not carry electrical current.

Referring to FIGS. 1, 2A and 2B, an electrical bus wire 35 is present proximate to the end of the substantially tubular substrate 50 that is opposite the end at the base portion of the substantially tubular substrate 50. When a lamp 500 including the light engine 100 is considered, the base portion of the lamp 55, which includes the screw electrode 66 is the portion of the lamp 500 that the base portion of the substantially tubular substrate 50 is in closest proximity to; and the portion of the substantially tubular substrate 50 including the electrical bus wire 35 may be referred to the upper portion of the substantially tubular substrate 50, which is closes to the uppermost portion of the optic 70 of the lamp 500. The electrical bus wire 35 is in contact with each filament LED for each of the first group of at least two filament LEDs 25*a* and each of the second group of at least two filament LEDs 25*b*. The electrical bus wire 35 is a continuous wire that extends without breaks along the perimeter of the substantially tubular substrate 50, as depicted in FIGS. 1, 2A and 2B.

The substantially tubular substrate 50 can be made of any suitable transparent material having suitable operating temperature characteristics. One such example is a plastic like polycarbonate. Other materials could also be used as can be envisioned by a person skilled in the art, such as glass, e.g., silicate glass, soda lime silicate glass, borosilicate glass or a combination thereof. The term "tubular" is meant to denote the hollow center of the structure. The exterior geometry may include at least one curvature, e.g., be circular or oblong or elliptical, and in this case can be substantially cylindrical in shape. In other embodiments, the substantially tubular substrate 50 may have an exterior geometry that is multi-sided. For example, the substantially tubular substrate 50 may have a cross section that is square or rectangular, or may have an even greater number of sidewalls, such as polygon geometries including pentagon—5 sides, hexagon—6 sides, heptagon—7 sides, octagon—8 sides, nonagon—9 sides, decagon—10 sides and other polygon geometries.

Figure 3:
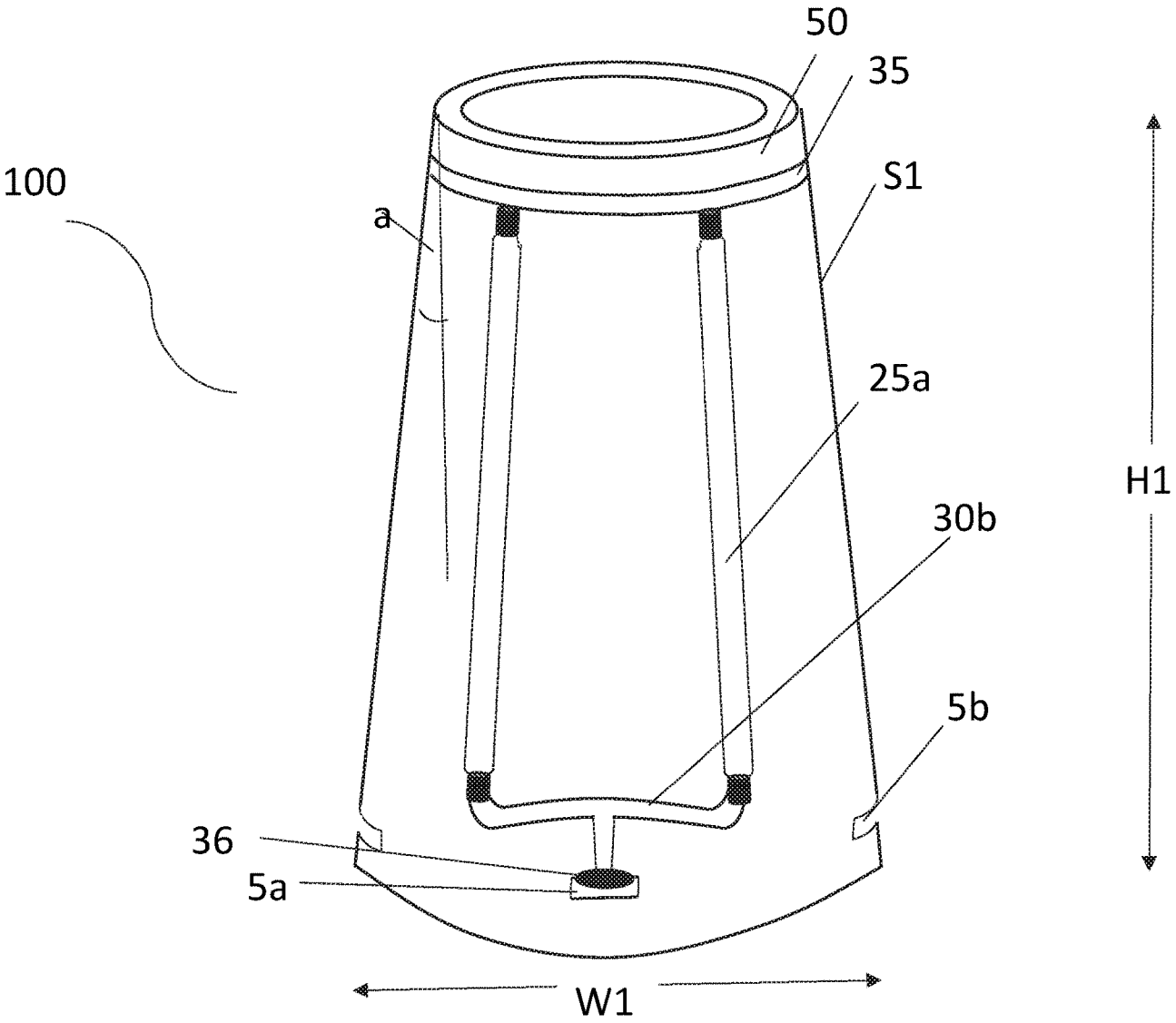
FIG. 3 is a perspective view of a light engine including a substantially tubular substrate with a tapered sidewall having a base portion with a plurality of slots extending into the substantially tubular substrate sidewall, and a plurality of filament light emitting diodes (LEDs) mounted to the substantially tubular substrate, in accordance with one embodiment of the present disclosure.

Referring to FIG. 3, in some other embodiments, the substantially tubular substrate 50 may have sidewalls that are tapered toward the top of the substantially tubular substrate 50 with a suitable angle α of taper. In one embodiment, the angle of taper can be from 2° to 45° from the vertical, as depicted in FIG. 3. In another embodiment, the angle α of taper can be 5° to 30° from the vertical. In some examples, the angle α of taper can be 5°, 10°, 15°, 20°, 25°, 30°, 35°, 40°, as well as any range of angles including one of the aforementioned values for the lower end of the range, and one of the aforementioned values for the upper end of the range.

In some embodiments, the outside diameter (also referred to as width) W1 of the substantially tubular substrate 50 may range from approximately ½" to approximately 1.5". In some other embodiments, the outside diameter (also referred to as width) W1 of the substantially tubular substrate 50 may range from approximately ¾" (approximately 18 mm) to approximately 1" (approximately 26 mm). It is noted that these dimensions are provided for illustrative purposes only, and are not intended to limit the present disclosure. Other dimensions outside diameters for the substantially tubular substrate 50 are suitable, so long as the substantially tubular substrate 50 fits within the globe 70 of a lamp 500.

In some embodiments, the height H1 of the substantially tubular substrate 50 may range from approximately 1" to approximately 3". In some other embodiments, the height H1 of the substantially tubular substrate 50 may range from approximately 1.25" (approximately 30 mm) to approximately 2.5" (approximately 60 mm). It is noted that these dimensions are provided for illustrative purposes only, and are not intended to limit the present disclosure. Other dimensions height H1 for the substantially tubular substrate 50 are suitable, so long as the substantially tubular substrate 50 fits within the globe 70 of a lamp 500.

Referring to FIGS. 1-3, the substantially tubular substrate 50 may include a plurality of slots 5*a*, 5*b*. The slots 5*a*, 5*b*, which can also be referred to as openings, may extend through the entirety of the sidewall S1 of the substantially tubular substrate 50. The dimensions of the slots 5*a*, 5*b* may be selected to accommodate pins 76 for the purposes of providing electrical communication, i.e., electrical current, to the first and second groups of the at least two filament LEDs 25*a*, 25*b*; and for engaging the pins of supporting members 77, which may also be provided by metal wires. The supporting structures 77 mechanically engage the light engine 100 to the stem structure 85 of a lamp 500. As will be described in further details herein, the pins (horizontal portions of lead wires 76*h* and horizontal portions of supporting members 77*h*) may be the top end of an L-shaped geometry structure. In the supplied figures, the slots having reference number 5*a* are for engaging the pins for the lead wires 76 of the stem structure 85, in which the slots 5*a* are in electrical communication to the first and second groups of the at least two filament LEDs 25*a*, 25*b*. It is noted that in addition to providing electrical current to the first and second groups of the at least two filament LEDs 25*a*, 25*b*, the engagement of the pins from the lead wires 76 of the stem structure 85 also provide mechanical support for the engagement of the light engine 100, i.e., the substantially tubular substrate 50 and the first and second groups of the at least two filament LEDs 25*a*, 25*b*. In the supplied figures, the slots having reference number 5*b* are for engaging the pins for support structures, i.e., supporting members 77, that do not carry current. These engagement of these pins to the slots 5*b* provide additional mechanical support for the engagement of the light engine 100, i.e., the substantially tubular substrate 50 and the first and second groups of the at least two filament LEDs 25*a*, 25*b*.

The two slots 5*a* in the lower end of substantially cylindrical substrate 50 that engage the ends of the two pins of the electrically conductive metal lines, i.e., lead wires 76, that provide for current to the at least two filaments 25*a*, 25*b* may be at the same height as the two slots 5*b* that engage the ends of pins for the supporting members 77 or they may be higher or they may be lower depending on ease of manufacturing. The shape of the slots 5*a*, 5*b* may be square, rectangular or any other shape that is amenable for manufacturing. Although the depicted embodiments include four slots 5*a*, 5*b*, the scope of the present methods and structures covers the use of additional non-current carrying pins, if required in manufacturing and/or for structural integrity of the envelope. Thus the total number of slots 5*a*, 5*b* may be four or more.

A light emitting diode (LED) is a form of solid state light emitter. The term "solid state" refers to light emitted by solid-state electroluminescence, as opposed to incandescent bulbs (which use thermal radiation) or fluorescent tubes, which use a low pressure Hg discharge. In a broad sense, a light emitting diode (LED) is a semiconductor device that emits visible light when an electric current passes through it. Some examples of solid state light emitters that are suitable for the methods and structures described herein include inorganic semiconductor light-emitting diodes (LEDs), surface mount light emitting diodes (SMT LEDs), chip scale LEDs or combinations thereof.

Referring to FIGS. 1-4C, the substrate 28 for each of the light emitting diode (LED) filament structures 25*a*, 25*b* includes a plurality of series connected light emitting diodes (LEDs) 29 present on the substrate 28 and extending from the cathode contact portion 27 to the anode contact portion 26.

Figure 4A:
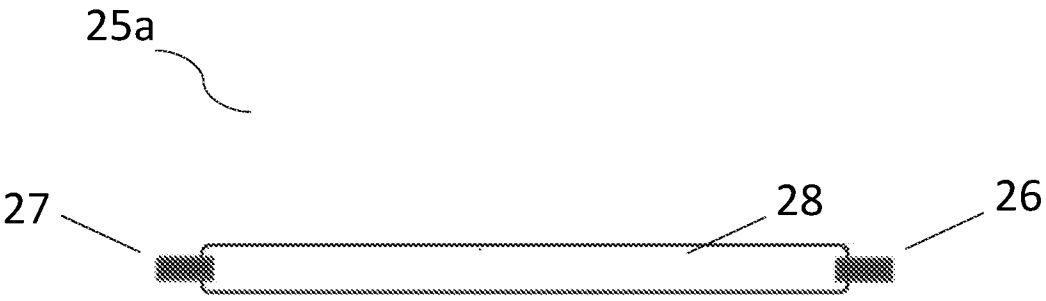
FIGS. 4A-4C are perspective views of a filament light emitting diode (LED), in accordance with one embodiment of the present disclosure.
Figure 4B:
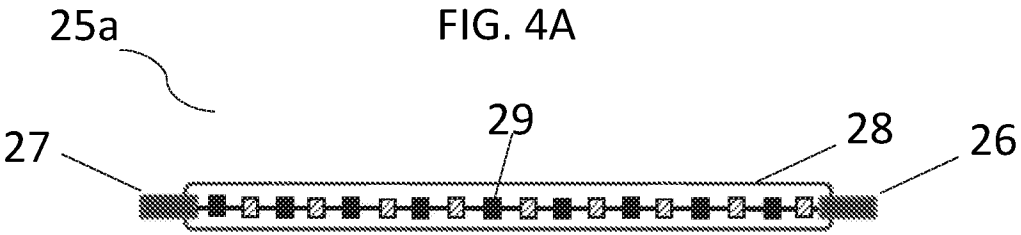
Figure 4C:
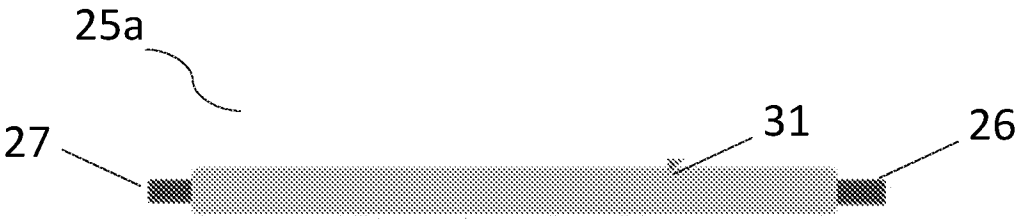

FIG. 4A illustrates one embodiment of the substrate 28 that is positioned between the anode contact portion 26 and the cathode portion 27. In some embodiments, the substrate 28 may be a transparent substrate, which can be made from glass, or sapphire, e.g., aluminum oxide ($Al_2O_3$). This transparency allows the emitted light to disperse evenly and uniformly without any interference or light loss. In some other embodiments, the substrate 28 may be a metal strip. It is noted that although FIGS. 4A-4C illustrate a filament LED having reference number 25*a*, the description of the filament LED depicted in FIGS. 4A-4C is equally applicable to the filament LEDs that are described herein having reference number 25*b*. In some embodiments, the substrate 28 that is depicted in FIG. 4A may be referred to as the first layer of the filament LED 25*a*, 25*b*.

Referring to FIG. 4B, in some embodiments, each of the light emitting diode (LED) filament structures 25*a* includes LED's 29 (also referred to as LED dies) arranged in rows on small strips. The number of LED dies 29 on any one filament may range from 10 upwards. In one example, the number of LEDs 29 arranged on the substrate 28 of the light emitting diode (LED) filaments structures 25*a* can range from 10 LEDs to 50 LEDs. In another example, the number of LEDs 29 arranged on the substrate 28 may range from 15 LEDs to 40 LEDs. In yet another example, the number of LEDs 29 arranged on the substrate 28 may range from 20 LEDs to 30 LEDs. The LEDs 29 present on the substrate 28 can be electrically connected in series extending from the cathode contact portion 27 to the anode contact portion 26. In the embodiment depicted in FIG. 4B, the LEDs 29 may be interconnected in series using a connective wire.

The LEDs 29 and connective elements to provide for series connection can be referred to as the second layer of the filament LED, which is present atop the substrate 28. The LED die 29 can be made of $In_xGa_yN_z$ where the x, y and z refer to different stoichiometric compositions. The form factor of the dies for the LEDs 29 can be 1128, 0922, 0815, 0714, 0627 or smaller. The first two digits and the last two digits are the dimensions of the die in thousandths of an inch. This list is by no means exhaustive and other form factors are within the scope of the present disclosure.

FIG. 4C illustrates one embodiment of a phosphor coating 31 that is present atop the LEDs 29, which are present on the substrate 28. In one example, the LED's 29 on the filament strip, i.e., substrate 28, emit a blue colored light. For example, the blue light emitted by the LEDs 29 on the filament strip, i.e., substrate 28, of the LED filaments 25*a* may have wavelengths ranging from approximately 490 nm to 450 nm. To provide "white light" a coating of phosphor 31 in a silicone resin binder material can be placed over the LEDs 29, and glass to convert the blue light generated by the LEDs 29. White light is not a color, but a combination of all colors, hence white light contains all wavelengths from about 400 nm to 700 nm. Different color phosphor coatings 31 can be used to change the color of the light being emitted by the LEDs 29. For example, the more yellow the phosphor coating 31, the more yellow and warm the light becomes. In some embodiments, the phosphor coating 31 that is depicted in FIG. 4C may be referred to as the third layer of the filament LED 25*a*, 25*b*.

Figure 5:
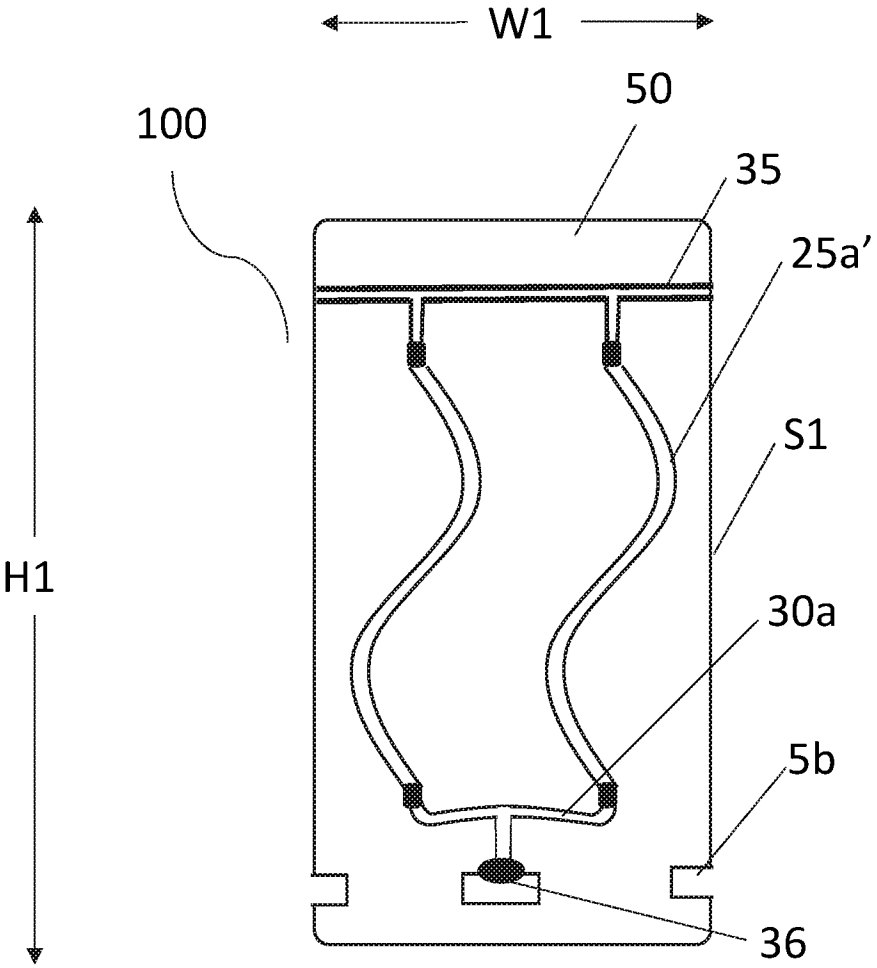
FIG. 5 is a side view of a light engine depicting at least two filament LEDs, in which each of the filament LEDs include at least one curvature, in accordance with one embodiment of the present disclosure.

While linear filament LEDs 25*a*, 25*b* are shown in FIGS. 1-4C, curved filament LEDs 25*a* can also be used without going outside the scope of methods and structures of the present disclosure, as depicted in FIG. 5

Referring to FIGS. 1-5, the filament LEDs 25*a*, 25*b* may range in length from ¾" and upwards. In one example, each of the light emitting diode (LED) filament structures 25*a*, 25*b* may have a length on the order of 4" and a width on the order of ⅛".

Referring to FIGS. 1-5, in some embodiments, the white light emitted by the light emitting diode (LED) filament structures 25*a*, 25*b* have a color temperature ranging from 2700K to 6500K. In one example, the white light emitted by the LED filaments structures 25*a*, 25*b* may be referred to a "day white" with a temperature ranging from 3800K to 4200K. In another example, the white light emitted by the light emitting diode (LED) filament structures 25*a*, 25*b* may have a warm white light with a temperature ranging from around 2600K to 3000K. It is noted that the above examples are provided for illustrative purposes only, and are not intended to limit the present disclosure.

Referring to FIGS. 1-5, the two or more LED filaments 25, 25*b* may be electrically connected in several series (S) and/or parallel (P) configurations like 2S, 2P2S, 3P2S, 3S2P etc. For example, each of the at least two filament LEDs 25*a* in the first group are electrically connected in parallel, and each of the at least two filament LEDs 25*b* in the second group are electrically connected in parallel. Further, the first group of said at least two filament LEDs 25*a* on a first portion of the substantially tubular substrate sidewall S1 is electrically connected in series with the second group of said at least two filament LEDs 25*b* through the electrical bus wire 35.

In some embodiments, the parallel connection between the filament LEDs within the first group of the at least two filament LEDs 25*a* is provided by a first connection for the parallel relationship of one contact, e.g., anode 26 and/or cathode 27, between the filament LEDs 25*a* and a first base electrode wire 30*a* that is connecting each of the first group of said at least two filament LEDs 25*a* to a first electrode contact 36 in a first of the plurality of slots 5*a*. To provide the parallel connection between the filament LEDs within the group of the at least two filament LEDs 25*a*, a second connection for the parallel relationship of an opposing second contact, e.g., anode 26 and/or cathode 27, is provided between the filament LEDs 25*a* and the electrical bus wire 35.

In some embodiments, the parallel connection between the filament LEDs within the second group of the at least two filament LEDs 25*b* is provided by a first connection for the parallel relationship of one contact, e.g., anode 26 and/or cathode 27, between the filament LEDs 25*b* and a first base electrode wire 30*b* that is connecting each of the first group of said at least two filament LEDs 25*b* to a first electrode contact 36 in a first of the plurality of slots 5*a*. To provide the parallel connection between the filament LEDs within the group of the at least two filament LEDs 25*b*, a second connection for the parallel relationship of an opposing second contact, e.g., anode 26 and/or cathode 27, is provided between the filament LEDs 25*b* and the electrical bus wire 35.

In some embodiments, the first base electrode wire 30*a* is located on a first side of the substantially tubular substrate 50 by a suitable distance above the slot 5*a* that engages current carrying pin of the lead wires extending from the stem 85 of the lamp. A similar second base electrode wire 30*b* is located on the opposite side of substantially tubular substrate 50, and is located a similar distance above the other slot 5*a* for engaging the other current carrying of the lead wires extending from the stem 85 of the lamp.

The first base electrode wire 30*a* is separate from the second base electrode wire 30*b*. The length of wire for each of the first and second base electrode wire 30*a*, 30*b* is suitably less than 45% of the circumferential length of the substantially tubular substrate 50. In some embodiments, the first and second base electrode wires 30*a*, 30*b* can be affixed to the outside surface of the substantially tubular substrate 50 by any suitable means, one of which may include adhesive engagement. In some embodiment, each of the first and second base electrode wires 30*a*, 30*b* are connected by an electrical connector 36 to the slots 5*a* that hold the pins of the lead wires to the stem structure 85 of a lamp. This establishes electrical contact from the pin leads to the first and second base electrode wires 30*a*, 30*b*. Thus both the first and second base electrode wires 30*a*, 30*b* act as an electrical bus wire. Electrical connector 36 can be any suitable means like a wire, cable, solder, solder pad etc. The engagement of the light engine 100 and the stem 85 of the lamp structure is further described with reference to FIG. 6.

Referring to FIGS. 1-5, the electrical bus wire 35 is a continuous wire that extends without breaks along the perimeter of the substantially tubular substrate 50, in which the electrical bus wire 35 is present at an opposite end of the substantially tubular substrate 50 than the first and second base electrode wires 30*a*, 30*b*. The end of the substantially tubular substrate 50 that the electrical bus wire 35 is present at may be referred to as the upper end of the substantially tubular substrate 50. The wire that provide the electric bus wire 35 may be affixed to the substantially tubular substrate 50 by any suitable means, one of which could be by adhesive engagement.

The electrical bus wire 35 may be in electrical contact with each of the filament LEDs in the first group of the at least two LED filaments 25*a*, and is simultaneously in electrical contact with each of the filament LEDs in the second group of the at least two LED filaments 25*b*. In this example, there is a series electrical connection between the at least two filament LEDs in the first group 25*a* that are electrically connected in parallel, and the at least two filament LEDs in the second group 25*b* that are electrically connected in parallel. Each LED filament 25*a*, 25*b* has two electrical leads 26, 27 (also referred to as anode contact 26 and cathode contact 27) one at each end of the filament 25*a*, 25*b*. The leads 26, 27 can be soldered to the electrical bus wire 35 at the upper end of the substantially tubular substrate 50, and can be soldered to the corresponding first or second base electrode wires 30*a*, 30*b* at the lower end of the substantially tubular substrate 50. It is also conceivable that first or second base electrode wires 30*a*, 30*b* and the electric bus wire 35 are magnetic and the leads 26, 27 (anode 26, cathode 27) of the filament LEDs 25*a*, 25*b* are magnetically attracted to the first or second base electrode wires 30*a*, 30*b* and the electric bus wire 35 thereby holding the filaments in place, without the need for soldering.

It is noted that while the filament LEDs 25*a*, 25*b* in this description are located on the outside surface, i.e., outside sidewall S1, of the substantially tubular substrate 50, the scope of the present disclosure also covers the use of filament LEDs 25*a*, 25*b* on the inside surface of substantially tubular substrate 50, the filaments being held in place by methods similar to those described when filaments 109 are located on the outside surface of substantially tubular substrate 50.

In the embodiments depicted in FIGS. 1-5, direct current (DC) enters the light engine through the LED filaments of the first group of at least two LED filaments 25*a*, and the direct current exits through the LED filaments of the second group of at least two LED filaments 25*b*. This particular configuration has the four LED filaments as a 2P2S assembly, meaning that two filaments are in series and we have two of these sets in parallel.

The total direct current feeding into the system of LED filaments 25*a*, 25*b* may range from 8 mA to 100 mA. The forward voltage of the system of LED filaments 25*a*, 25*b* may range from 120V to 360V. The light emission pattern from the filaments may be 2π radians (360°). The light emission pattern from the filaments may also be less than 2π radians (360°).

It is noted that while four filament LEDs 25*a*, 25*b* are depicted in the figures of the present disclosure, any multiple of 2 filaments could be used for each of the firsts and second groups of LEDs. For example, the number of light emitting diode (LED) filament structures 25*a*, 25*b* may be equal to 2, 4, 6, 8, 10 and 12, as well as any range of light emitting diode (LED) filament structures 25*a*, 25*b* including one of the aforementioned examples for the minimum endpoint for the range, and one of the aforementioned examples for the maximum endpoint for the range. In all cases the filaments will be connected between wires the first or second base electrode wires 30*a*, 30*b* and the electric bus wire 35.

Figure 6:
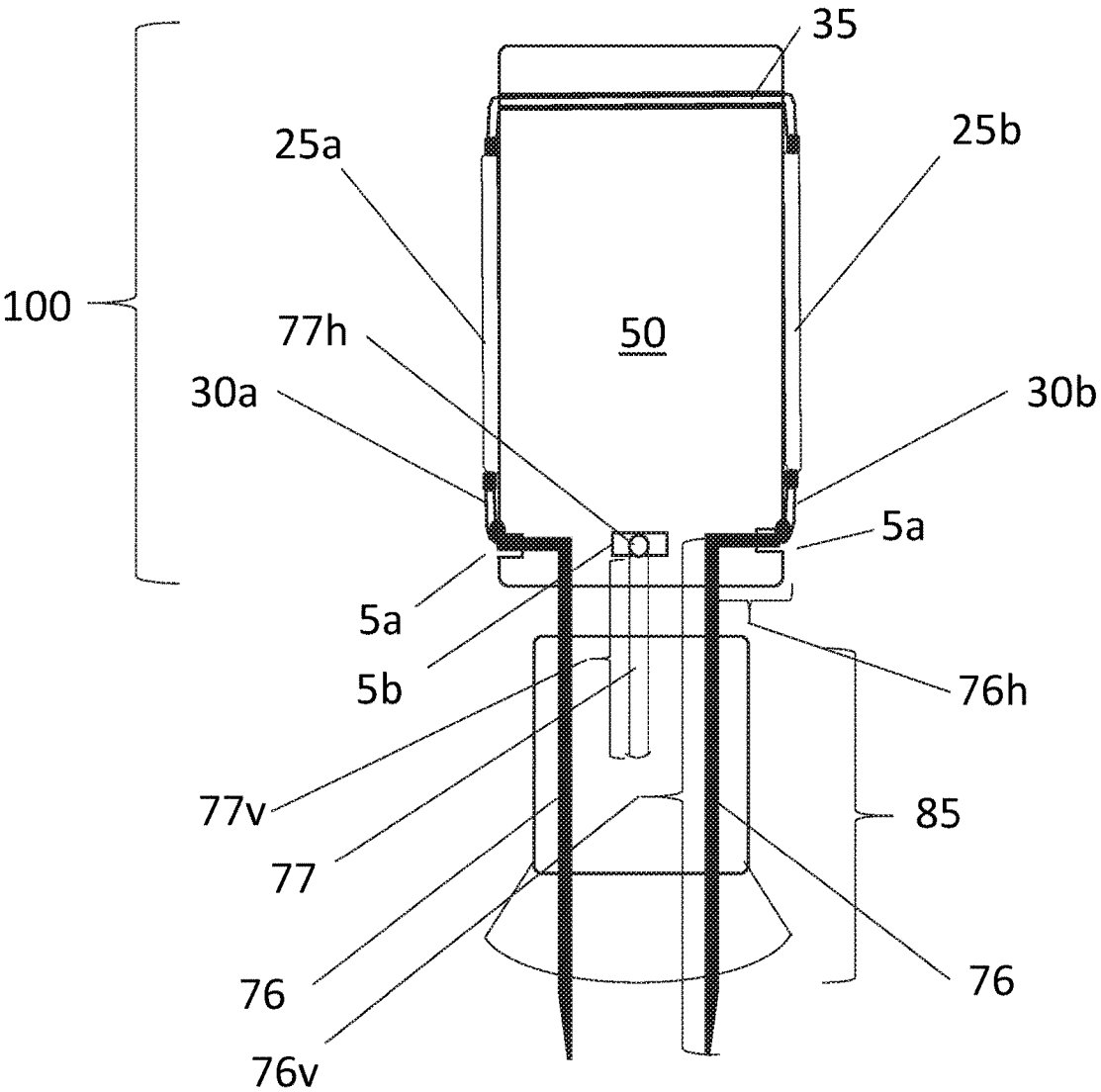
FIG. 6 is a side view illustrating a light engine, as depicted in FIGS. 1 and 2A-2B, being engaged to a light stem, in accordance with one embodiment of the present disclosure.
Figure 7:
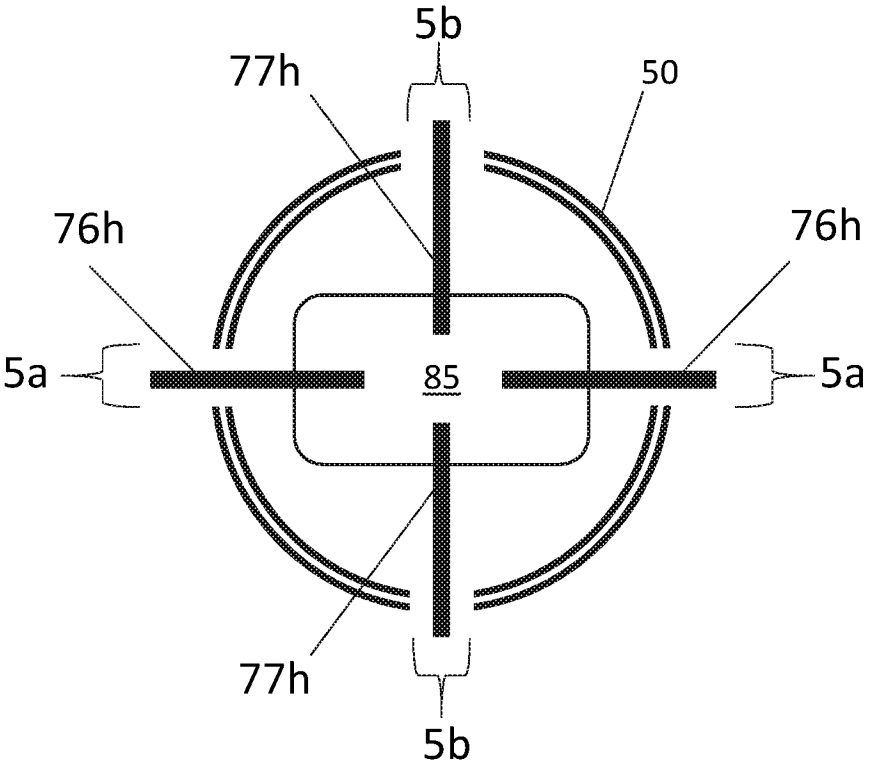
FIG. 7 is a top down view of a cross-section of the structure depicted in FIG. 6 further depicting the light engine being engaged to the light stem.

FIG. 6 is a side view illustrating a light engine 100, as depicted in FIGS. 1 and 2A-2B, being engaged to a light stem 85 (also referred to as stem structure 85). In the side view depicted in FIG. 6 one of the filament LEDs from the first group of at least two filament LEDs 25*a*, and one of the filament LEDs from the second group of the at least two filament LEDs 25*b* is depicted. FIG. 7 is a top down view of a cross-section of the structure depicted in FIG. 6 further depicting the light engine 100 being engaged to the light stem 85.

In a lamp structure in accordance with some embodiments of the present disclosure, the light engine 100 is positioned within the globe 70, i.e., optic of the lamp, by connection to lead wires 76 that are supported by the stem 85. The stem 85 is a column like structure extended toward the inside of the globe 70. In the embodiment that is depicted in FIGS. 6 and 7, the light engine 100 includes electrical contacts 36 that are present in slots 5*a*, which are in electrical communication with the first and second groups of at least two filament LEDs 25*a*, 25*b*. The slots 5*a* are formed in the sidewall S1 of the substantially tubular substrate 50. Therefore, by connection of the lead wires 76, which are structurally rigid, to the slots 5*a* that are formed in the sidewalls of substantially tubular substrate 50 of the light engine 100, in addition to carrying electrical current to the light engine 100, the lead wires 76 are structurally supporting the light engine 100 in engagement to the stem 85.

In some embodiments, the stem 85 is composed of glass, and includes two right angle shaped electrical lead wires 76. These lead wires 76 may be composed of nickel (Ni) plated steel or an alternate suitable material. For example, the lead wires 76 may also be a composite wire including an internal lead wire, a Dumet wire (copper-clad nickel steel wire) and an external lead wire joined in this order.

Referring to FIGS. 1-5, the length (also referred to as height H1) of the sidewall of the substantially tubular substrate 50 extends in a direction from the base portion at which the plurality of slots 5*a*, 5*b* are present to an opposing end at which the electrical bus wire 35 is present. In some embodiments, the length of filament LEDs for the first and second groups of the at least two filament LEDs 25*a*, 25*b* is substantially parallel with the length of the sidewall of the substantially tubular substrate 50.

Referring to FIGS. 6 and 7, in some embodiments, the lead wires 76 having the L-shaped geometry, i.e., right angle shape, include a horizontally orientated portion identified by reference number 76*h*, which may be referred to as pins, and a vertically orientated portion identified by reference number 76*v*. The upper segment of the vertically orientated portion 76*v* is the electric wire extending from the stem 85 to the light engine 100, and supporting the light engine 100 through engagement of the horizontally orientated portion 76*h*, which is also referred to as a pin, to the slots 5*a* in the sidewalls of the substantially tubular substrate 50 of the light engine 100. The lower segment of the vertically orientated portion 76*v*, which is continuous with the upper segment of the vertically orientated portion 76*v* and the horizontally orientated portion 76*h*, is an electric wire extending from the driver electronics 80, e.g., lighting circuit, to the stem 85. Therefore, in addition to structural support for engaging the light engine 100 to the stem 85, the lead wires 76 carry electrical current from the driver electronics 80 to the light engine 100 for powering the filament LEDs of the first and second groups of at least two filament LEDs 25*a*, 25*b*. At least a portion of the electrical lead wires 76 are encapsulated in the stem 85.

It is noted that there are two lead wires 76 (e.g., a first lead wire and a second lead wire) extending from the light engine 100 through the stem 85 to the driver electronics. The lead wires 76 may be positioned so that the first lead wire 76 having a pin, i.e., horizontal portion 76*h*, engaging the slot 5*a* on the side of the substantially tubular substrate 50 containing the first group of the at least two filament LEDs 25*a* is diametrically opposite the second lead wire 76 having a pin, i.e., horizontal portion 76*h*, engaging the slot 5*a* on the side of the substantially tubular substrate 50 containing the second group of the at least two filament LEDs 25*b*. In some embodiments, the ends of pins (horizontal portion 76*h*) extend a suitable distance beyond the outside surface of the substantially tubular substrate 50 when the pins (horizontal portion 76*h*) are engaged to the slots 5*a*.

In some embodiments, the stem 85 includes additional structural pins (also referred to as supporting members 77), which can be composed of metal wire having a same geometry as the lead wires 76 for engaging the slots 5*b* extending into the substantially tubular substrate sidewall 50 that do not include electrical contacts to the filament light emitting diodes 25*a*, 25*b*. In some embodiments, the supporting members 77 can have a geometry that is shaped like the lead wires 76 that are extending from the stem 85 into contact with the light engine 100. For example, the supporting members 77 may have an L-shaped geometry, i.e., right angle shape, include a horizontally orientated portion identified by reference number 77*h*, which may be referred to as pins, and a vertically orientated portion identified by reference number 77*v*. Unlike the lead wires 76, in some embodiments, the supporting members 77 do not carry any current but provide additional structural rigidity to the substantially tubular geometry 50 of the light engine 50.

Referring to FIG. 7, although the supporting members 77 may have a shape similar to the lead wires 76, in some embodiments, the pins 77*h* for the supporting members 77 may be located about 90 degrees relative to the pins 76*h* for the lead wires 76. Referring to FIG. 7, the supporting members 77 engage the slots identified by reference number 5*b* in the sidewalls of the substantially tubular substrate 50, while the lead wires 76 engage the slots identified by reference number 5*a* in the sidewalls of the substantially tubular substrate 50. The two slots 5*b* in the lower end of substantially tubular substrate 50 that engage the ends of the pins, i.e., horizontally orientated portions 77*h*, of the supporting members 77 may be at the same height as the two slots 5*a* that engage the ends of pins, i.e., horizontally orientated portions 76*h*, of the lead wires 76, or the slots 5*b* may be higher or lower that the slots 5*a* depending on ease of manufacturing. The shape of the slots 5*a*, 5*b* may be square, rectangular or any other shape that is amenable for manufacturing.

It is noted that while the embodiments that are illustrated in FIGS. 1-7 illustrate four pins, i.e., two horizontally orientated portions 76*h* for two lead wires 76, and two horizontally orientated portions 77*h* for two supporting members 77, the scope of the present disclosure covers the use of additional non-current carrying pins, i.e., supporting members 77, if required in manufacturing, for structural integrity of the substantially tubular substrate 50 or for a combination of those reasons. Therefore, in some embodiments, the total number of pins may be four or more.

The stem 75 can be made of soft glass transparent to visible light.

The light engine 100 described with reference to FIGS. 1-5 may be joined to the stem 85 depicted in FIGS. 6 and 7 by welding, such as resistance welding, of the pins, i.e., horizontally orientated portions of the lead wires 76*h*, to electrical contacts 36 within the slots 5*a*. Other welding methods may also be employed, as well as adhesive engagement and/or soldering methods. In other embodiments, the dimensions of the slots 5*a*, 5*b* are selected to provide for a frictional fit between the slots 5*a*, 5*b*, and the pins, i.e., horizontally orientated portions of the wires 76*h*, 77*h*, in which the friction fit engages the light engine 100 to the stem 85. Adhesives may also be provided to engage the pins, i.e., horizontally orientated portions of the wires 76*h*, 77*h*, to the slots 5*a*, 5*b*.

Figure 8:
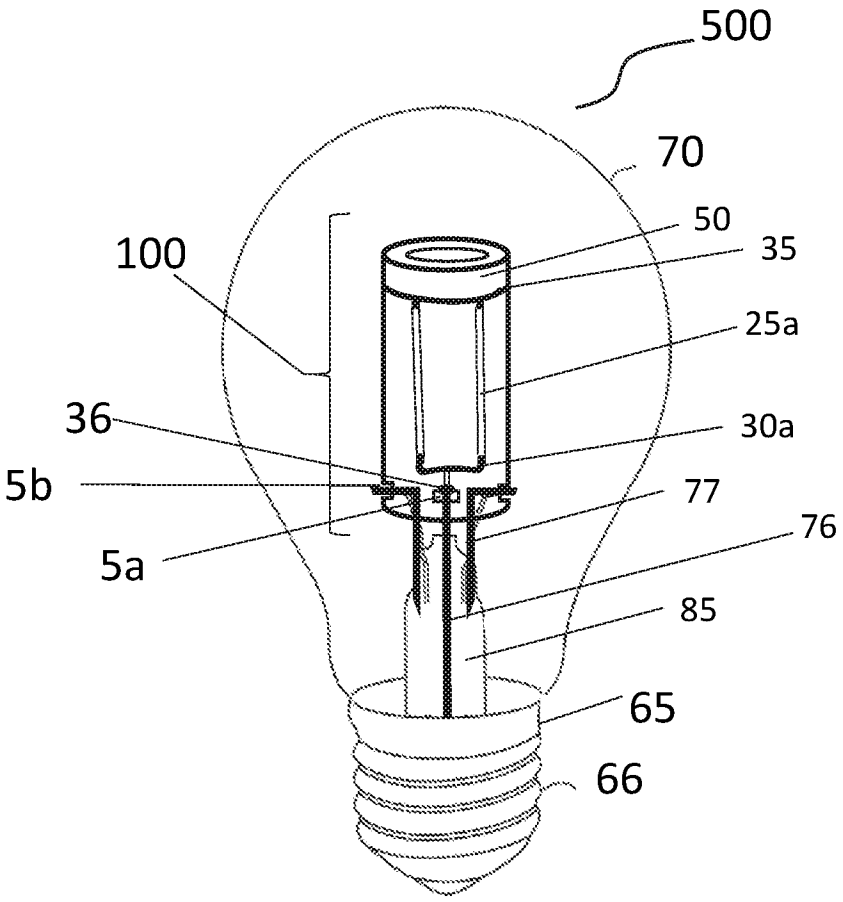
FIG. 8 is a perspective view illustrating a lamp including a light engine composed of a plurality of light emitting diode (LED) filament structures as depicted in FIGS. 1 and 2A-2B, in accordance with one embodiment of the present disclosure.
Figure 9:
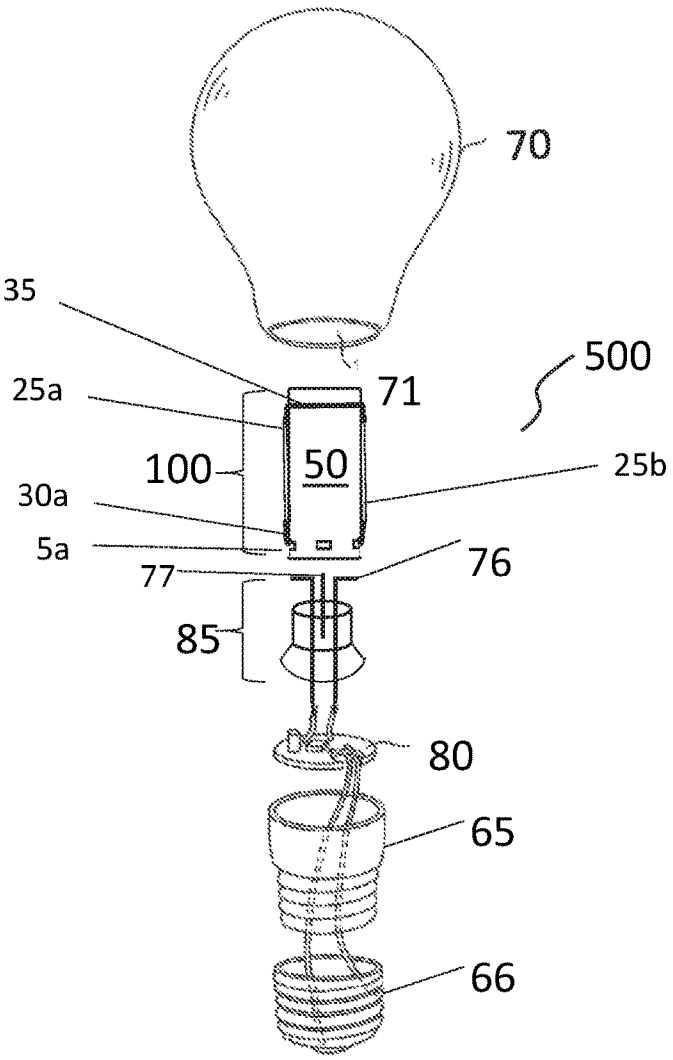
FIG. 9 is an exploded view of the lamp that is depicted in FIG. 8.

In another aspect, the light engine 100 that has been described with reference to FIGS. 1-7, is incorporated into a lamp 500, as depicted in FIGS. 8-9. FIGS. 8-9 illustrate one embodiment of lamp 500 that may include a housing including a light projecting end (present at the optic 70) and a base 65 having an electrical connector 66 for connection with a lamp fixture; and a light engine 100 positioned within the housing to project light through the light projecting end. The light engine 100 has been described above with reference to FIGS. 1-7. For example, the light engine 100 includes a substantially tubular substrate 50 including base a portion with a plurality of slots 5*a*, 5*b* extending into the substantially tubular substrate sidewall S1, and a plurality of filament light emitting diodes (LEDs) 25*a*, 25*b* mounted to the substantially tubular substrate 50, wherein electrical contacts 36 to the plurality of filament light emitting diodes (LEDs) 25*a*, 25*b* are present in said plurality of slots 5*a*. The lamp 500 may further include a light stem 85 including positive and negative leads, i.e., lead wires 76, connected to the electric contacts 36 that are present in the plurality of slots 5*a* of the substantially tubular substrate 50 of the light engine 100. The positive and negative leads, i.e., lead wires 76, are in electrical communication with the electrical connector 36 through driver electronics 80 that are housed within the base 65. FIG. 8 depicts a lamp 500 including a light engine 100 composed of a plurality of light emitting diode (LED) filament structures 25*a*, 25*b*, as depicted in FIGS. 1-6. FIG. 9 is an exploded view of FIG. 8.

As illustrated in FIGS. 8 and 9, the light bulb shaped lamp 500 is a light bulb shaped LED lamp that can function for replacing an incandescent electric bulb, in which a base 65 is attached to a translucent globe 70. The light engine 100 including the light emitting diode (LED) filament structures 25*a*, 25*b* is housed in the globe 70. The light engine 100 including the light emitting diode (LED) filament structures 25*a*, 25*b* is directly fixed to the stem 85 extending from an opening 71 of the globe 70 toward the inside of the globe 70. The stem 85 is in electrical communication with driver electronics, e.g., lighting circuit 80, in which the driver electronics are in electrical communication with the portion of the base 65 that engages the lamp fixture.

In some embodiments, the globe 70 is a hollow translucent component, houses the light engine 100 inside, and transmits the light from the light engine 100 to outside of the lamp 500. In some embodiments, the globe 70 is a hollow glass bulb made of silica glass transparent to visible light. In other embodiments, the globe 70 may be composed of transparent plastic. The globe 70 can have a shape with one end closed in a spherical shape, and the other end having an opening 71. In other words, the shape of the globe 70 is that a part of hollow sphere is narrowed down while extending away from the center of the sphere, and the opening 71 is formed at a part away from the center of the sphere. In the embodiment that is depicted in FIGS. 8 and 9, the shape of the globe 70 is Type A (JIS C7710) which is the same as a common incandescent light bulb. It is noted that this geometry is provided for illustrative purposes only, and is not intended to limit the present disclosure. For example, the shape of the globe 70 may also be Type G, Type E, or others.

The light engine 100 that is housed within the globe 70 has been described above with reference to FIG. 1-6. That description is incorporated herein for describing the light engine 100 of the lamp 500 that is described with reference to FIGS. 8 and 9.

The light engine 100 is positioned within the globe 70 by connection to the lead wires 76 and supporting member 77 that are supported by the stem 85. The stem 85 is a column like structure that is extended toward the inside of the globe 70. In some embodiments, the stem structure 85 is positioned between the light engine 100 and the driver electronics 80, wherein connection between the light engine 100 and the driver electronics 80 includes connection of the lead wires 76, and supporting members 77, that are extending from the upper surface of the body of the stem 85 into contact with the slots 5*a*, 5*b* of the tubular supporting substrate 50. In some embodiments, the other end portion of the body of the stem 85 includes a flared shape that can be coinciding with the shape of the opening 71. The other end portion of the body of the stem 85 can be formed in the flared shape to be joined with the opening 71 of the globe 70 so as to close the opening of the globe 70. In other embodiments, the flared shape of the stem 85 may engage a first surface of the base housing 65 and the globe 70 may contact a second separate surface of the base housing 65, wherein between the base housing 65, the globe 70 and the flared end portion of the stem 85, a sealed structure is provided. In addition, parts of two lead wires 76 can be partially sealed in the stem 85. Accordingly, it is possible to supply power to the light engine 100 in the globe 70 from outside of the globe 70 keeping the globe 70 airtight. Accordingly, the light bulb shaped lamp 500 can prevent water or water vapor from entering the globe 70 for a long period of time, and it is possible to suppress the degradation of the light engine 100 and a part connecting the light engine 100 and the lead wire 76 due to moisture.

The stem 85 can be made of soft glass transparent to visible light. This structure of the light bulb shaped lamp 500 suppresses loss of light from the light engine 100 by the stem 85. In addition, the light bulb shaped lamp 500 can prevent the shadow cast by the stem 85.

In addition to providing electric current to the filament LEDs 25*a*, 25*b* of the light engine 100, the two lead wires 76 support the light engine 100 and hold the light engine 100 at a constant position in the globe 70. The supporting members 77 also provide structure support for the light engine. The engagement of the light engine 100 to the stem 85 by the lead wires 76 and the supporting members 77 is described in greater detail with reference to FIGS. 6 and 7 above. That description is incorporated herein for describing the engagement of the light engine 100 to the stem 85 within the lamp 500 that is described with reference to FIGS. 8 and 9. That description is also incorporated herein for describing how the engagement of the lead wires 76 from the stem 85 to the light engine 100 provide for the passage of electrical current to the filament LEDs 25*a*, 25*b* within the lamp 500 that is described with reference to FIGS. 8 and 9.

Referring to FIGS. 8 and 9, in one embodiment, the driver electronics 80, e.g., lighting circuit, is a circuit for causing the LEDs of the plurality of light emitting diode (LED) filament structures 25*a*, 25*b* to emit light, and is housed in the base housing 65. More specifically, the driver electronics 80, e.g., lighting circuit, includes a plurality of circuit elements, and a circuit board on which each of the circuit elements is mounted. In this embodiment, the driver electronics 80, e.g., lighting circuit, converts the AC power received from the base 66 of the base housing 65 to the DC power, and supplies the DC power to the LEDs of the plurality of light emitting diode (LED) filament structures 25*a*, 25*b*, through the two lead wires 76. In one embodiment, the driver electronics 80 is a lighting circuit that may include a diode bridge for rectification, a capacitor for smoothing, and a resistor for adjusting current. The lighting circuit is not limited to a smoothing circuit, but may be an appropriate combination of light-adjusting circuit, voltage booster, and others.

The driver electronics 80 may be housed within a base housing 65 that is composed of a resin material. The base housing 65 can be provided at the opening 71 of the globe 70. More specifically, the base housing 65 is attached to the globe 70 using an adhesive such as cement to cover the opening 71 of the globe 70.

The base 66 is connected to the end of the base housing 65 that is opposite the end of the base housing 65 that is closest to the globe 70. In the embodiment that is depicted in FIGS. 9 and 9, the base 66 is an E26 base. The light bulb shaped lamp 500 can be attached to a socket for E26 base connected to the commercial AC power source for use. Note that, the base 66 does not have to be an E26 base, and maybe a base of other size, such as E17. In addition, the base 66 does not have to be a screw base, and may be a base in a different shape such as a plug-in base.

In another aspect, a method for incorporating the light engine 100 that has been described with reference to FIGS. 1-7 into the lamp structures 500 depicted in FIGS. 8 and 9 is provided. The method of forming the lamp 500 may include providing a light engine component 100 including a substantially tubular substrate 50, in which the substantially tubular substrate 50 includes a base portion with a plurality of slots 5*a*, 5*b* extending through the substantially tubular substrate sidewall. The light engine 100 also includes a plurality of filament light emitting diodes (LEDs) 25*a*, 25*b* mounted to the substantially tubular substrate 50, wherein electrical contacts 36 to the plurality of filament light emitting diodes (LEDs) 25*a*, 25*b* are present in the plurality of slots 5*a*, 5*b*. The method further includes connecting a light stem 85 including positive and negative leads 76 to the electric contacts 36 that are present in the plurality of slots 5*a* of the substantially tubular substrate 50 of the light engine 100. The method may further include sealing the light engine 100 within the housing 65 including a light projecting end provided by an optic 70 and a base 65 having an electrical connector 66 for connection with a lamp fixture, wherein the positive and negative leads 76 of the light stem 85 are in electrical communication with the electrical connector 66 through driver electronics 80 that are housed within the base 65.

In some embodiments, the plurality of filament light emitting diodes 25*a*, 25*b* includes a first group of at least two filament LEDs 25*a* on a first portion of the substantially tubular substrate sidewall, and a second group of at least two filament LEDs 25*b* on a second portion of the substantially tubular substrate sidewall. The method may further include interconnectivity of the filament LEDs 25*a*, 25*b* by a first base electrode wire 30*a* connecting each of the first group of said at least two filament LEDs 25*a* to a first electrode contact 36 in a first of the plurality of slots 5*a*, and a second base electrode wire 30*b* connecting each of the second group of said at least two filament LEDs 25*b* to a second electrode contact 36 in a second of the plurality of slots 5*a*, wherein the first base electrode wire 30*a* is separate from the second base electrode wire 30*b*. The method may also include providing interconnectivity between each of the filament LEDs 25*a*, 25*b* through an electrical bus wire 35 that is present proximate to the end of the substantially tubular substrate 50 that is opposite the end at the base portion of the substantially tubular substrate 50. More specifically, the electrical bus wire 35 can be in contact with each filament LED for each of the first group of at least two filament LEDs 25*a* and each of the second group of at least two filament LEDs 25*b*.

In some embodiments, the light stem 85 employed in the method includes positive and negative leads 76 that are substantially encapsulated in glass of the light stem body 85, wherein protruding portions have a vertically orientated portion and a horizontally orientated portion, the horizontally orientated portion of the positive and negative leads being pins for engaging the slots 5*a* including the electrical contacts 36 to the filament light emitting diodes (LEDs) 25*a*, 25*b*.

In some embodiments, the light stem 85 that is employed in the method further includes supporting members 77 that can be composed of metal wires having a same geometry at the positive and negative leads for engaging the slots 5*b* extending into the sidewall of the substantially tubular substrate 50 that do not include electrical contacts to the filament light emitting diodes 25*a*, 25*b*.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Having described preferred embodiments of a light emitting diode filament light source, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A light engine comprising:

a substantially tubular substrate including a base portion with a plurality of slots extending into a sidewall of the substantially tubular substrate;

a first group of at least two filament LEDs on a first portion of the substantially tubular substrate, and a second group of at least two filament LEDs on a second portion of the substantially tubular substrate;

a first base electrode wire connecting each of the first group of said at least two filament LEDs to a first electrode contact in a first of the plurality of slots, and a second base electrode wire connecting each of the second group of said at least two filament LEDs to a second electrode contact in a second of the plurality of slots, wherein the first base electrode wire is separate from the second base electrode wire; and an electrical bus wire present proximate to the end of the substantially tubular substrate that is opposite the end at the base portion of the substantially tubular substrate, the electrical bus wire being a continuous wire that extends without breaks along a perimeter of the substantially tubular substrate, the electrical bus wire in contact with each filament LED for each of the first group of at least two filament LEDs and each of the second group of at least two filament LEDs.

2. The light engine of claim 1, wherein the substantially tubular substrate has a cylindrical geometry.

3. The light engine of claim 1, wherein the substantially tubular substrate is composed of glass, a polymeric material, or a combination thereof.

4. The light engine of claim 1, wherein the substantially tubular substrate is composed of a light transmissive material.

5. The light engine of claim 1, wherein the each of the at least two filament LEDs in the first group are electrically connected in parallel, and wherein each of the at least two filament LEDs in the second group are electrically connected in parallel.

6. The light engine of claim 1, wherein the first group of said at least two filament LEDs on a first portion of the substantially tubular substrate sidewall is electrically connected in series with the second group of said at least two filament LEDs through the electrical bus wire.

7. The light engine of claim 1, wherein a length of the substantially tubular sidewall extends in a direction from the base portion at which the plurality of slots are present to an opposing end at which the electrical bus wire, and a length of filament LEDs for the first and second groups of the at least two filament LEDs is substantially parallel with the length of the substantially tubular sidewall.

8. The light engine of claim 1, wherein the at least two filament LEDs for the first and second group are engaged to an exterior sidewall of the substantially tubular substrate.

9. A lamp structure comprising:

a housing including a light projecting end and a base having an electrical connector for connection with a lamp fixture;

a light engine positioned within the housing to project light through the light projecting end, the light engine including a substantially tubular substrate including a base portion with a plurality of slots extending into a sidewall of the substantially tubular substrate, and a plurality of filament light emitting diodes (LEDs) mounted to the substantially tubular substrate so that a body of the filament light emitting diodes is in direct contact with an exterior sidewall of the substantially tubular substrate, wherein electrical contacts to the plurality of filament light emitting diodes (LEDs) are present in said plurality of slots; and a light stem including positive and negative leads connected to the electric contacts that are present in the plurality of slots of the substantially tubular substrate of the light engine component, wherein the positive and negative leads are in electrical communication with the electrical connector through driver electronics that are housed within the base.

10. The lamp structure of claim 9, wherein the plurality of filament light emitting diodes includes a first group of at least two filament LEDs on a first portion of the substantially tubular substrate, and a second group of at least two filament LEDs on a second portion of the substantially tubular substrate.

11. The lamp structure of claim 10 further comprising a first base electrode wire connecting each of the first group of said at least two filament LEDs to a first electrode contact in a first of the plurality of slots, and a second base electrode wire connecting each of the second group of said at least two filament LEDs to a second electrode contact in a second of the plurality of slots, wherein the first base electrode wire is separate from the second base electrode wire; and an electrical bus wire present proximate to the end of the substantially tubular substrate that is opposite the end at the base portion of the substantially tubular substrate, the electrical bus wire in contact with each filament LED for each of the first group of at least two filament LEDs and each of the second group of at least two filament LEDs.

12. The lamp structure of claim 11, wherein the light stem includes said positive and negative leads that are substantially encapsulated in glass of the light stem body, wherein protruding portions have a vertically orientated portion and a horizontally orientated portion, the horizontally orientated portion of the positive and negative leads being pins for engaging the slots including the electrical contacts to the filament light emitting diodes (LEDs).

13. The lamp structure of claim 12, wherein the positive and negative leads are provided by metal wires.

14. The lamp structure of claim 12, wherein the light stem further includes supporting member composed of metal wires have a same geometry at the positive and negative leads for engaging the slots extending into the substantially tubular substrate that do not include electrical contacts to the filament light emitting diodes.

15. A method of forming a lamp comprising:

providing a light engine component including a substantially tubular substrate, the substantially tubular substrate including base portion with a plurality of slots extending into a sidewall of the substantially tubular substrate, and a plurality of filament light emitting diodes (LEDs) mounted to the substantially tubular substrate, wherein electrical contacts to the plurality of filament light emitting diodes (LEDs) are present in said plurality of slots;

connecting a light stem including positive and negative leads to the electric contacts that are present in the plurality of slots of the substantially tubular substrate of the light engine component, wherein the light stem includes positive and negative leads that are substantially encapsulated in glass of the light stem body, wherein protruding portions have a vertically orientated portion and a horizontally orientated portion, the horizontally orientated portion of the positive and negative leads being pins for engaging the slots including the electrical contacts to the filament light emitting diodes (LEDs); and sealing the light engine component within a housing including a light projecting end provided by an optic and a base having an electrical connector for connection with a lamp fixture, wherein the positive and negative leads of the light stem are in electrical communication with the electrical connector through driver electronics that are housed within the base.

16. The method of claim 15, wherein the plurality of filament light emitting diodes includes a first group of at least two filament LEDs on a first portion of the substantially tubular substrate, and a second group of at least two filament LEDs on a second portion of the substantially tubular substrate.

17. The method of claim 16 further comprising a first base electrode wire connecting each of the first group of said at least two filament LEDs to a first electrode contact in a first of the plurality of slots, and a second base electrode wire connecting each of the second group of said at least two filament LEDs to a second electrode contact in a second of the plurality of slots, wherein the first base electrode wire is separate from the second base electrode wire; and an electrical bus wire present proximate to the end of the substantially tubular substrate that is opposite the end at the base portion of the substantially tubular substrate, the electrical bus wire in contact with each filament LED for each of the first group of at least two filament LEDs and each of the second group of at least two filament LEDs.

18. The method of claim 15, wherein the positive and negative leads are provided by metal wires.

19. The method of claim 18, wherein the light stem further includes supporting member composed of metal wires have a same geometry at the positive and negative leads for engaging the slots extending into the substantially tubular substrate sidewall that do not include electrical contacts to the filament light emitting diodes.

* * * * *